United States Patent [19]

Freeman et al.

[11] 4,162,544

[45] Jul. 31, 1979

[54] SAFETY RAILING

[75] Inventors: Joseph T. Freeman, Philadelphia; Aaron Colish, Bala Cynwyd, both of Pa.

[73] Assignee: Bath-Ladd Corporation, Philadelphia, Pa.

[21] Appl. No.: 874,720

[22] Filed: Feb. 3, 1978

[51] Int. Cl.[2] ..... A47K 3/12

[52] U.S. Cl. ..... 4/185 H

[58] Field of Search ..... 4/185 R, 185 H, 254

[56] References Cited

U.S. PATENT DOCUMENTS 3,568,220 3/1971 Dees ..... 4/185

FOREIGN PATENT DOCUMENTS 173676 12/1934 Switzerland ..... 4/185 H
559031 2/1975 Switzerland ..... 4/185 H
292737 6/1928 United Kingdom ..... 4/254
749644 5/1956 United Kingdom ..... 4/185 H
943137 11/1963 United Kingdom ..... 4/185 H

*Primary Examiner*—Charles E. Phillips
*Attorney, Agent, or Firm*—Seidel, Gonda, Goldhammer & Panitch

[57] ABSTRACT

A safety railing for attachment to a wall comprised of a generally triangular frame with the corners of the triangle having a generally curvilinear shape. At least one gripping bar extends between and is attached to two sides of the triangular frame. A mechanism is provided for attaching the frame to a wall at a spaced distance from the wall and substantially parallel to the wall.

10 Claims, 3 Drawing Figures

SAFETY RAILING

BACKGROUND OF THE INVENTION

Safety railings generally of the type disclosed herein are used in various areas. Safety railings can be attached either to a wall adjacent a bathtub or shower, or directly to a side wall of a bathtub itself. Safety railings can also be attached to a wall adjacent a toilet. Safety railings are especially useful in aiding injured, handicapped or infirmed persons during bathing.

SUMMARY OF THE INVENTION

The present invention relates to a safety railing for attachment to a wall. The railing is comprised of a generally triangular frame with the corners of the triangle having a generally curvilinear shape. At least one gripping bar extends between and is attached to two sides of the triangular frame. A means for attaching the frame to a wall at a spaced distance from the wall and substantially parallel to the wall is provided.

In the preferred embodiment, the frame takes the configuration of an isosceles triangle. The frame is preferably attached to a wall adjacent a bathtub in a base upward disposition. The base of the triangle frame is placed in a generally horizontal disposition and the curved apex of the triangle contacts a portion of the bathtub. A means for holding soap or towels is also attached to the frame, together with a separate box for storing articles such as glasses, dentures, hearing aids during bathing.

These attachments are movable to adjust to the needs of the individual.

BRIEF DESCRIPTION OF THE DRAWINGS

For the purpose of illustrating the invention, there is shown in the drawings a form which is presently preferred; it being understood, however, that the invention is not limited to the precise arrangements and instrumentalities shown.

DETAILED DESCRIPTION OF THE INVENTION

Figure 1:
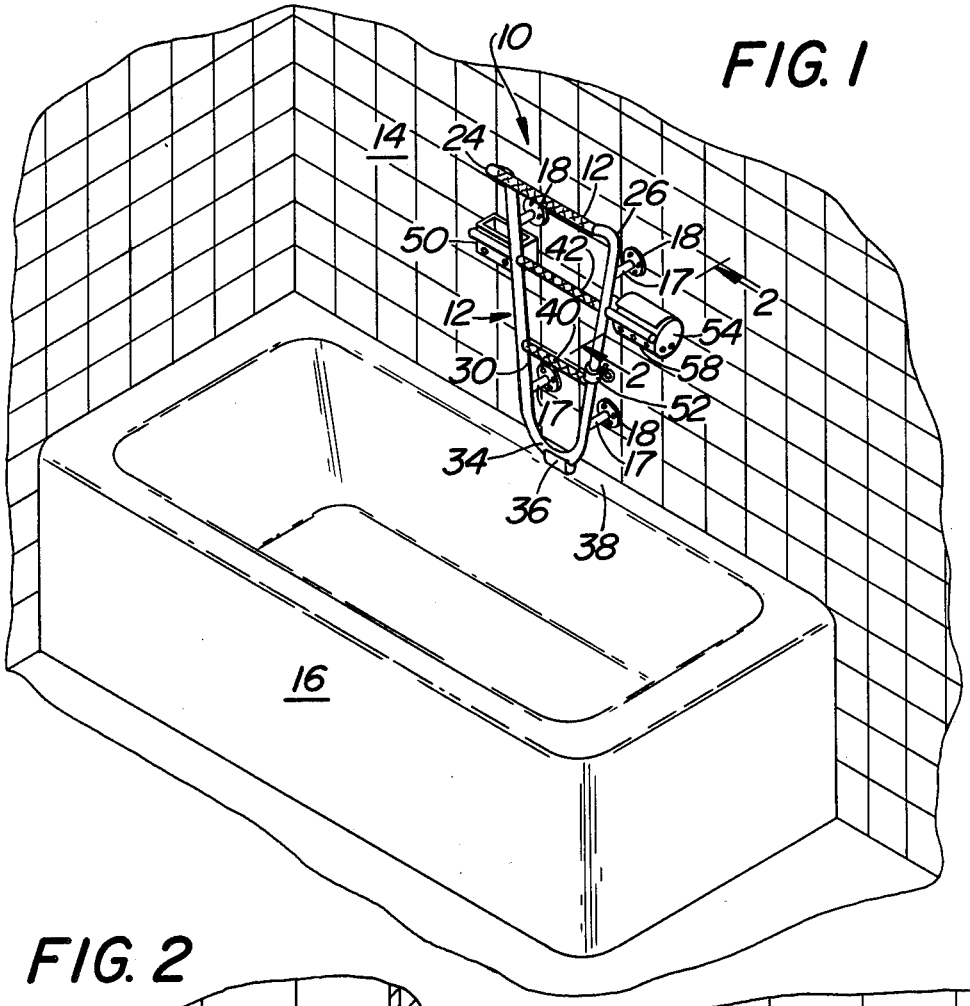
FIG. 1 is a perspective view illustrating the safety railing attached to a wall adjacent a bathtub.

Referring to the drawings in detail, wherein like numerals indicate like elements, there is shown in FIG. 1 a safety railing in accordance with the present invention designated generally as 10. The safety railing 10 is formed of a generally triangular frame 12. The triangular frame 12 is adapted to be fixedly secured to a wall 14. In the preferred embodiment, the frame is secured to a wall 14 adjacent a bathtub 16.

A plurality of attachment means, such as circular flanges 18, are attached to the triangular frame 12 via lengths of non-corrosive material pipe 17. The flanges 18 are attached to the triangular frame 12 by means of short lengths of material 17. When the triangular frame 12 is secured to the wall 14 by fasteners 19 extending through flanges 18, the frame 12 is secured in a predetermined spaced disposition from the wall 14. The triangular frame 12 is preferably in the form of an isosceles triangle and is constructed of a non-corrosive material. The top bar or base portion 22 of the triangular frame 12 is in a horizontal disposition when the frame 12 is secured to the wall 14. The corners 24, 26 between the top bar 22 and the side portions 30, 32 are generally curvilinear in configuration. The curvilinear configuration of the corners 24, 26 provides a smooth and safe surface. Also, by utilizing curved corners 24, 26, the area which may be held by a person utilizing the railing is increased.

The apex portion 34 joining the two side portions 28, 30 is also curvilinear in configuration. When the triangular frame 12 rests on a bathtub 16, one or more rubber members 36 are attached to the apex portion 34 resting on rim 38 of the bathtub 16 as an added means of support. The surface of the bathtub 16, as well as the triangular frame 12, are thus insulated or protected from one another.

A plurality of gripping bars 40, 42 extend between and are attached to the side portions 30, 32 of the triangular frame 12. The gripping bars 40, 42 are formed of a similar, non-corrosive material. The horizontally disposed top bar 22 also serves as a gripping bar. Thus, a person utilizing the safety railing 10 could grip a bar at any of a plurality of vertically spaced positions. In order to enhance the friction between the hand of a person holding on to the safety railing and the gripping bar itself, the outer surfaces 44, 46, 48 of the gripping bars 40, 42 and the base portion 22 are either made of a non-slip material or have a non-slip surface. One way of enhancing friction of the material or its surface is to either knurl or form diamond treads on the surfaces 44, 46 and 48.

The top bar 22 curves away from the plane in which the side portions 30, 32 lie. The side portions 30, 32 and the apex 34 are generally equidistant from the wall 14 since the pipes 17 are preferably of equal length. When the triangular frame 12 is secured to a wall, the top bar 22 thus is disposed a further distance away from the wall 14 than the remainder of the triangular frame 12. A person standing within a bathtub or shower who holds onto and leans on the top bar 22 wil have a greater degree of movability than he would if the base 22 were closer to the wall 14. The curve of the top portion serves as a spot equivalent to a cane.

Figure 2:
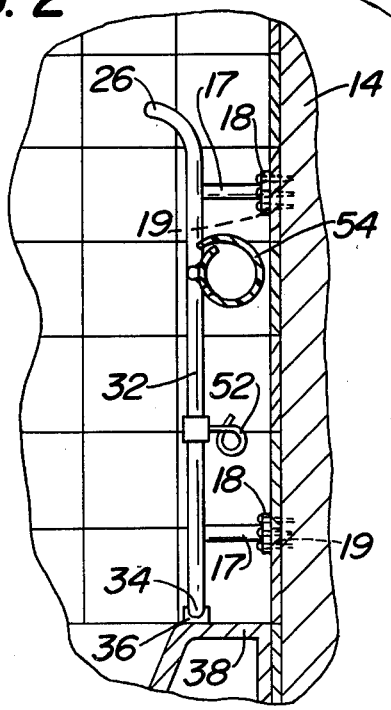
FIG. 2 is a view taken along lines 2—2 of FIG. 1 on an enlarged scale.
Figure 3:
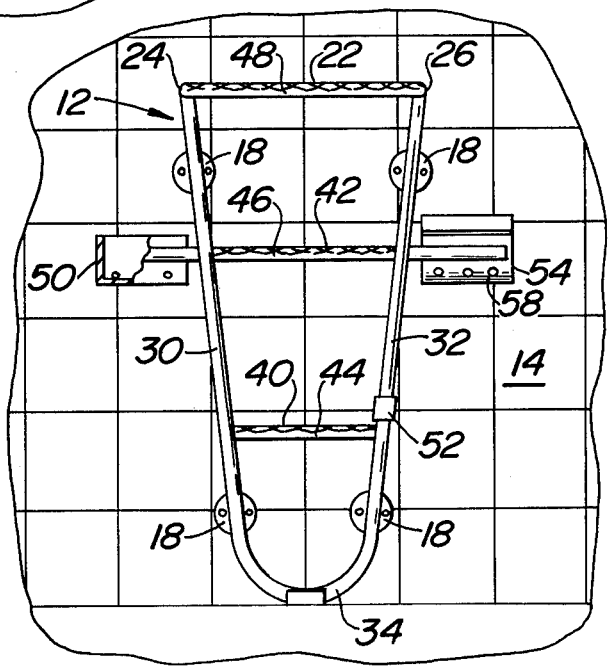
FIG. 3 is a front elevational view of the safety railing.

A plurality of accessory devices are attached to the frame 12. A soap or washcoth holder 50 is attached at one location to the frame 12. The holder 50 has a plurality of apertures through it in order to drain water therefrom. A ring or hook 52 for holding a cloth or a sponge is attached at another location on the frame 12. A box 54 for storing eyeglasses, hearing aids, teeth and the like during bathing is also attached at another location to the frame 12. The box 54 is a waterproof unit contoured to shed water with ventilation to prevent forming of condensation. Apertures 58 are formed within the side and bottom walls of the box 54 in order to drain any water that may accidentally enter the box 54. To aid in the drainage of water striking the top of the box 54, the waterproof top is contoured. See FIG. 2. The holder 50, the ring 52, and the box 54 are attached to the frame 12 by any suitable means, such as by clamping. The accessories 50, 52 and 54 also are preferably attached by the user. While the accessories 50, 52 and 54 are shown in specific locations in the drawings, the actual location at which the accessories 50, 52 and 54 are attached to the frame 12 are best determined by the user. Depending upon the specific infirmity of the person utilizing the safety railing, the optimum location of each accessory will be determined.

The frame 12 may be made of any suitable non-corrosive tubular material. A chrome plated metal or durable plastic material is preferred. The frame 12 is preferably 30 inches a high with the gripping bars 40, 42 and the base portion 22 spaced at 10 inch intervals. The base portion 22 in such an embodiment would be approximately 14 inches and the apex 34 is a 6 inch semi-circle. The vertically spaced, horizontally disposed gripping bars thus form a bath ladder.

The present invention may be embodied in other specific forms without departing from the spirit or essential attributes thereof and, accordingly, reference should be made to the appended claims, rather than to the foregoing specification, as indicating the scope of the invention.

What is claimed is:

1. A safety railing for attachment to a wall adjacent a bathtub comprising:

a frame substantially in the configuration of an isosceles triangle with the corners of the triangle being curvilinear;

said frame being adapted to be attached spaced from and substantially parallel to a wall with the portion of said frame forming the base of the triangle being uppermost and in a generally horizontal disposition and the portion of said frame forming the apex of the triangle contacting a portion of a bathtub;

means for attaching said frame to a wall;

means for holding soap attached to said frame; and a box for storing articles during bathing attached to said frame, said box having a top contoured to shed water.

2. A safety railing in accordance with claim 1 wherein at least one gripping bar extends between and is attached to the portions of said frame forming the sides of said triangle.

3. A safety railing in accordance with claim 2 wherein the base portion of said frame forms an additional gripping bar and curves away from the remainder of the frame to be disposed further from a wall than the remainder of said frame, and each of said gripping bars having a non-slip surface.

4. A safety railing in accordance with claim 2 wherein said soap holding means is an apertured dish shaped member

5. A safety railing in accordance with claim 2 wherein said storage box has apertured bottom and side walls and said top is non-apertured.

6. A safety railing comprising a generally triangular frame adapted to be attached to a wall with the portion of the frame forming a base of the triangle in an uppermost and generally horizontal position, the base portion of the frame being curved way from the remainder of the frame in a first direction whereby the base portion of the frame will be disposed further from a wall then the remainder of the frame, the corners of said triangular frame having a generally curvilinear shape, at least one gripping bar extending between and attached to the side portions of the triangular frame, said gripping bar being generally parallel to said base portion and being shorter than said base portion, and means extending from said frame in a direction opposite to said first mentioned direction for attaching said frame to a wall at a spaced distance from the wall.

7. A safety railing in accordance with claim 6 wherein said attaching means extends from said side portions of said frame in a direction generally perpendicular to vertical planes containing said frame side portions.

8. A safety railing in accordance with claim 6 wherein said triangular frame has the configuration of an isosceles triangle with the height of the triangle being greater than the length of said base.

9. A safety railing in accordance with claim 6 including a plurality of horizontally disposed gripping bars extending between and attached to the portions of the frame forming two sides of the triangle, said base portion of the frame forming an additional gripping bar, and each gripping bar having a non-slip surface.

10. A safety railing for attachment to a wall comprising a generally triangular frame; the corners of said triangle having a generally curvilinear shape; at least one gripping bar extending between and attached to two sides of said triangular frame; said frame being adapted to be attached to a wall with a portion of said frame forming a base of the triangle in an uppermost and generally horizontal position, said base portion of the frame curving away from the remainder of the frame whereby the base portion of the frame will be disposed further from a wall than the remainder of said frame, said frame being adapted to be secured to a wall adjacent a bathtub and a portion of said frame forming the apex of said triangle having a friction member for contacting a portion of a bathtub, and means for attaching said frame to a wall at a spaced distance from the wall and substantially parallel thereto.

* * * * *